US006065785A

United States Patent [19]

Mantarakis et al.

[11] Patent Number: 6,065,785

[45] Date of Patent: May 23, 2000

[54] PATIO DOOR LIMITER

[75] Inventors: Petros Z. Mantarakis, Northridge; Donald A. Becken, Burbank, both of Calif.

[73] Assignee: Reflectolite Products, Pacoima, Calif.

[21] Appl. No.: 09/073,202

[22] Filed: May 4, 1998

[51] Int. Cl.[7] ..... E05C 1/02

[52] U.S. Cl. ..... 292/181; 292/153; 292/162; 292/DIG. 15; 292/DIG. 46

[58] Field of Search ..... 292/175, DIG. 46, 292/156, 157, 162, 181, 177, 153, 145, 335, 244, DIG. 37, DIG. 15

[56] References Cited

U.S. PATENT DOCUMENTS

| | | | |
|---|---|---|---|
| 361,693 | 4/1887 | Guild | 292/153 |
| 459,676 | 9/1891 | Daniel | 292/156 |
| 559,600 | 5/1896 | Platt | 292/181 |
| 919,750 | 4/1909 | Neumeister | 292/153 |
| 987,529 | 3/1911 | Young | 292/153 |
| 1,036,583 | 8/1912 | Diedrich | 292/162 |
| 4,066,284 | 1/1978 | Ikemura | 292/62 |
| 4,552,392 | 11/1985 | Morello | 292/181 |
| 4,815,774 | 3/1989 | Correnti | 292/145 |
| 5,004,287 | 4/1991 | Doyle | 292/57.1 |
| 5,246,258 | 9/1993 | Kerschenbaum et al. | 292/144 |
| 5,664,812 | 9/1997 | Marinoni | 292/153 |
| 5,746,455 | 5/1998 | Takimoto | 292/62 |

FOREIGN PATENT DOCUMENTS

| | | | |
|---|---|---|---|
| WO 89/02965 | 4/1989 | WIPO | 292/244 |

*Primary Examiner*—Steven Meyers
*Assistant Examiner*—Clifford B Vaterlaus
*Attorney, Agent, or Firm*—Hill & Simpson

[57] ABSTRACT

A limiter or stop for a sliding door or sliding panel is provided. The limiter includes a shaft disposed within the escutcheon that is connected to a head. The head includes two spaced-apart holes for frictionally receiving locking rods or bars. The head is further connected to retaining elements for securing the rods in position after insertion. The rods may be manually removed and inserted into either hole in the head. Rods of differing lengths are provided. Accordingly, a single limiter is provided that may be installed in a variety of different positions.

11 Claims, 4 Drawing Sheets

PATIO DOOR LIMITER

FIELD OF THE INVENTION

The present invention relates generally to patio doors or sliding glass doors. More specifically, the present invention relates generally to stops or locks for patio doors or sliding glass doors. Still more specifically, the present invention relates to a limiter or a stop for holding a patio door or a sliding glass door in a partially-open position.

BACKGROUND OF THE INVENTION

Limiters, stops or so-called secondary locks for patio or sliding glass doors are known. Typically, these limiters include a rod that passes through an escutcheon. The rod is spring-biased upward in an unlocking position and can be depressed downward into a locking or stopped position. Normally, a hole is provided in the track or on a fixed panel anywhere from 2 to 10 inches from the vertical door frame. Extension of the rod into the hole holds the sliding door in the partially-open position. These devices are typically not referred to as "locks" because the door is held in a partially-open position. Thus, the terms "limiter" or "stop" are more appropriate.

A problem associated with the currently-available limiter or stop products is their lack of versatility. Specifically, the currently-available devices are equipped with only one locking rod that is permanently connected within the escutcheon. Further, the rod is disposed centrally along the axis of the escutcheon. While this design is suitable for some applications, it is proven to be inconvenient in light of the recent development of sliding glass doors with narrower frames. Simply put, with the narrower frames of modern sliding glass doors, there is less room for the attachment of the escutcheon and therefore it is often desirable to provide the bolt or rod in an off-center position with respect to the escutcheon.

Still further, the currently-available limiters or stops are equipped with not only a single rod, but with a single rod of a pre-determined length. Often, the rod is longer than necessary which requires the escutcheon to be mounted higher on the door frame than necessary, which degrades the aesthetic appearance of the door. Further, because the rods are permanently mounted within the escutcheon, there is no way to replace a rod that is either too short or too long with a rod of an alternative length.

Therefore, there is a need for an improved limiter or stop for a sliding door such as a patio door which provides the locking rod or bolt in an off-center position with respect to the central axis of the escutcheon and further which provides rods or bolts of varying lengths so that the installer may choose a rod of an appropriate length thereby enabling the escutcheon to be mounted as close to the track as possible or as close to the edge of the door as possible.

SUMMARY OF THE INVENTION

The present invention satisfies the aforenoted needs by providing an improved limiter for a sliding glass or patio door. The limiter of the present invention comprises a shaft having a first end connected to a head and a second opposing end connected to a cap. The head comprises at least two spaced apart holes. Each hole matably and detachably receives a rod that extends outward from the head and in a direction opposite the shaft. Because the rods are detachably received in the holes of head, the rods can be removed and inserted as necessary. Thus, only one rod need be used at a time. Further, rods of differing lengths may be provided so that a rod of an appropriate length may be inserted into one of the two spaced-apart holes.

In an embodiment, the head is disposed within an escutcheon. The escutcheon, in turn, is connected to the sliding door. The escutcheon comprises two opposing ends including a first end which comprises at least two through openings that are in axial alignment with the holes disposed in the head. The openings slidably accommodate the rods when inserted into one of the holes in the head. The second end of the escutcheon also includes a through opening for slidably accommodating the shaft. The escutcheon further comprises a bracket for slidably accommodating the shaft. A first biasing spring is trapped between the bracket and the cap for biasing the shaft into a retracted position.

In an embodiment, the biasing spring is disposed around the shaft.

In an embodiment, the bracket is connected to a retaining plate which engages the spring.

In an embodiment, the holes for accommodating the rods are offset from a central axis of the escutcheon.

In an embodiment, the escutcheon is pivotally connected to an actuator button. The button comprises two opposing ends including a first end that engages a second spring disposed between the button and the escutcheon and a second end. The second spring biases the first end of the button outwards away from the escutcheon and the second end of the button inwards towards the head. The head further comprises a ledge for engaging the second end of the button when the shaft and the head have been pushed past the second end of the button and into a limiting or activated position. Thus, as the cap, shaft and head are pushed downward into a limiting position, the head extends past the second end of the button, which is contemporaneously biased inwardly towards the head until the ledge of the head is in alignment with the second end of the button. The second end of the button then snaps into place within the ledge so that the limiter is retained in the limiting position. To release the limiter, the first end of the button is pressed inwardly against the bias of the second spring so that the second end of the button is released from the ledge of the head and the head and shaft move back to the retracted position under a force imposed by the first biasing spring.

In an embodiment, the limiter is provided in the form of a kit with two rods, including a first rod and a second rod. The two rods are of a different length, e.g., the first rod being longer than the second rod.

In an embodiment, each rod comprises a proximate end that is matably received in one of the holes of the head. Each proximate end of the rod includes a groove. The head is further connected to at least two retainers or retaining elements. Each retaining element extends into one of the holes and engages the groove of one of the rods for detachably connecting one of the rods to the head. In such an embodiment, the rods may be pushed into the holes and into an engagement with the retaining element and pulled out of the holes and out of engagement with one of the retaining elements by manual pressure.

It is therefore an advantage of the present invention to provide a stop or limiter for a sliding glass door which can accommodate locking rods of varying lengths and in different positions with respect to the central axis of the escutcheon.

Another advantage of the present invention is that it provides a limiter for a sliding glass or patio door in the form of a kit with a plurality of locking rods of varying lengths.

Yet another advantage of the present invention is that it provides a limiter or stop for a sliding glass or patio door that can be mounted to the door in a variety of positions.

Other objects and advantages of the present invention will become apparent upon reading the following detailed description and appended claims, and upon reference to the accompanying drawings.

BRIEF DESCRIPTION OF THE DRAWINGS

For a more complete understanding of the present invention, reference should now be made to the embodiments illustrated in greater detail in the accompanying drawings and described below by way of examples of the invention.

In the drawings.

It should be understood that the drawings are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted. It should be understood, of course, that the invention is not necessarily limited to the particular embodiments illustrated herein.

DETAILED DESCRIPTION OF THE PRESENTLY PREFERRED EMBODIMENTS

Figure 1:
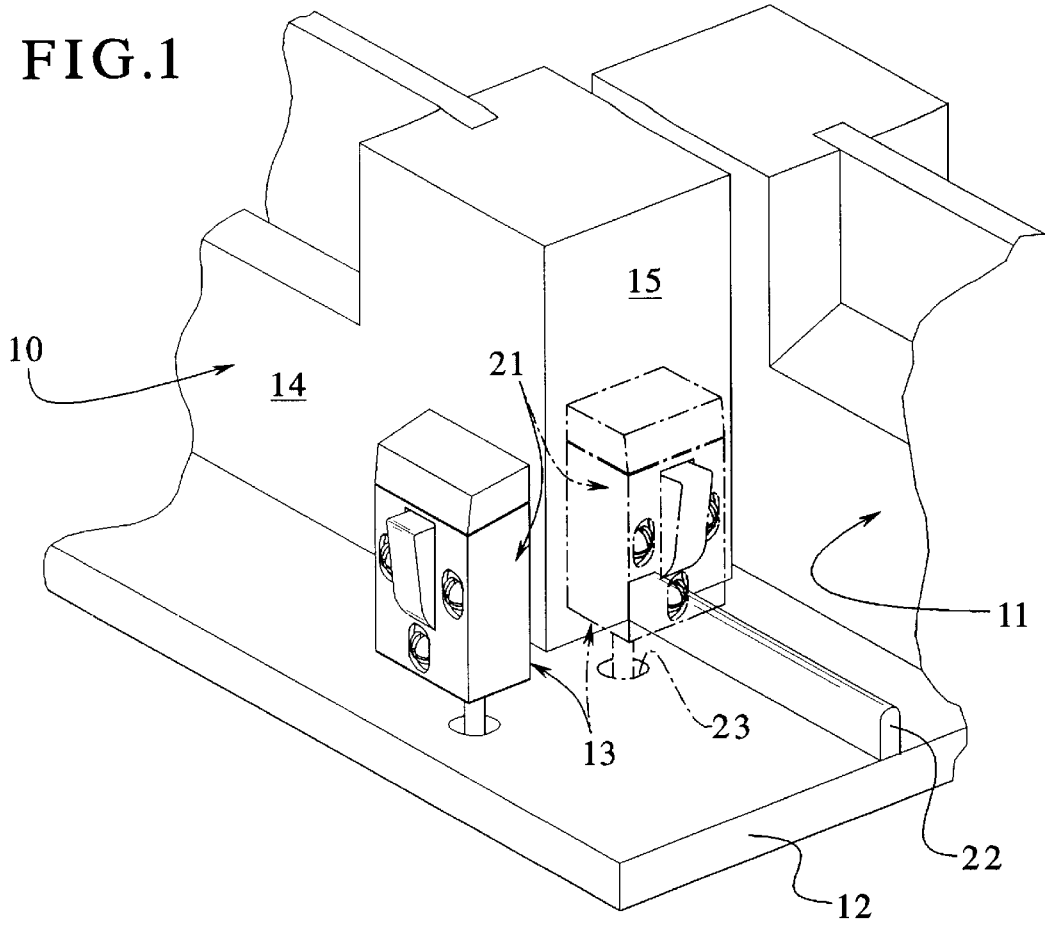
FIG. 1 is a partial perspective view of a sliding glass door equipped with the stop or limiter of the present invention, as shown in two possible installation positions.
Figure 2:
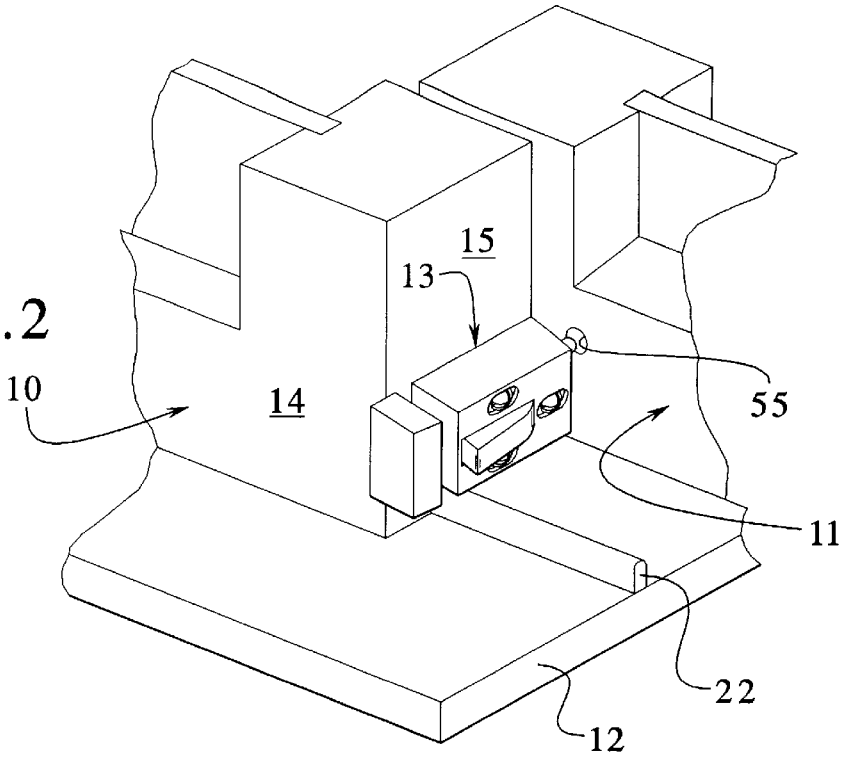
FIG. 2 is another partial perspective view of a sliding glass door equipped with a limiter of the present invention and mounted in a third installation position and shown in a deactivated or retracted position.
Figure 3:
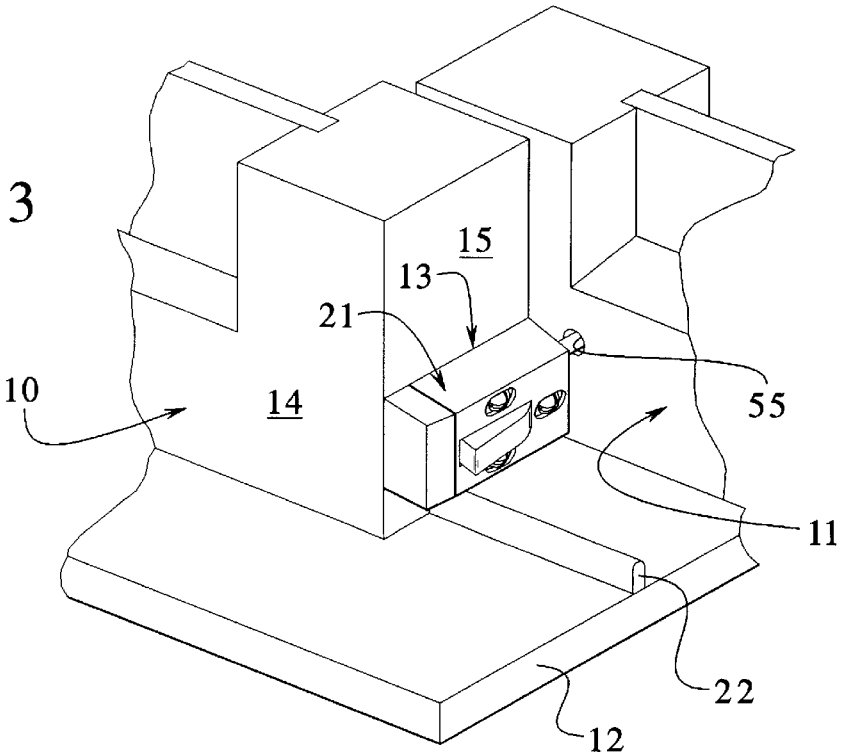
FIG. 3 is a perspective view of the sliding glass door and limiter as shown in FIG. 2 in the limiting or activated position.

Turning first to FIGS. 1–3, a sliding door 10 and a fixed door 11 are shown as mounted onto a track 12. A limiter 13 is shown as installed on the sliding door 10 on either the inside surface 14 of the door 10 (see FIG. 1) or the edge surface 15 of the door 10 (see FIGS. 2 and 3). Therefore, in addition to being mounted in the upright or vertical orientation as shown in FIG. 1, the limiter 13 of the present invention may also be mounted in a horizontal or sideways configuration on the edge 15 of the door as shown in FIGS. 2 and 3.

Figure 4:
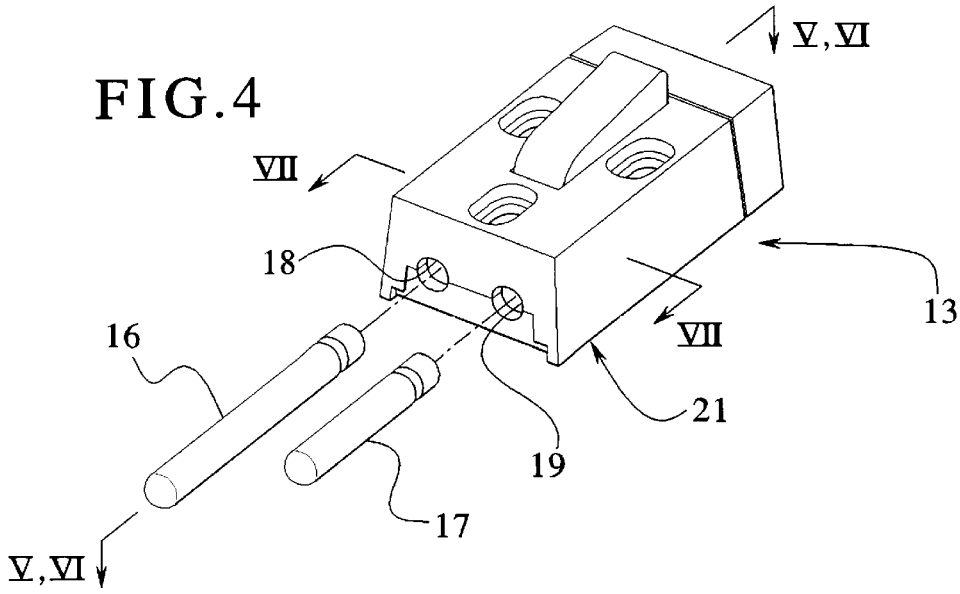
FIG. 4 is an exploded perspective view of the limiter of the present invention.

Referring to FIGS. 1 and 4, it will be noted that the limiter 13 can accommodate two rods 16, 17 in two holes 18, 19, both of which are offset from the axial center of an escutcheon 21. By providing holes 18, 19 for two rods 16, 17, a single rod may be utilized in an offset position with respect to the escutcheon 21. This ability comes particularly in handy if it is desired to mount the escutcheon 21 on the edge surface 15 of the door 10. Because of the requirement of an upwardly protruding rib 22 that guides the sliding movement of the door 10, it would be inconvenient or, at the very least cramped, to provide a single rod disposed along a central axis of the escutcheon 21. Therefore, by utilizing the offset hole 18 (see FIG. 4) a hole 23 may be drilled through the track 12 to the inside of the rib 22 with sufficient room to spare. If only a single hole was provided along the central axis of the escutcheon 21, there would be insufficient room to drill a hole to accommodate a single rod. Also, as shown in FIG. 1, when the escutcheon 21 is mounted on the inside surface 14 of the door 10, either hole 18 or 19 may be utilized. It will be also noted that the rods 16 and 17 are interchangeable within the holes 18, 19. The purpose for providing rods 16, 17 of different lengths is to enable the installer to mount the escutcheon 21 as low as possible on the door 10. Further, the use of the shorter rod 17 may be desirable if only a shallow hole can be provided in either the track 12 or the fixed door 11.

Figure 5:
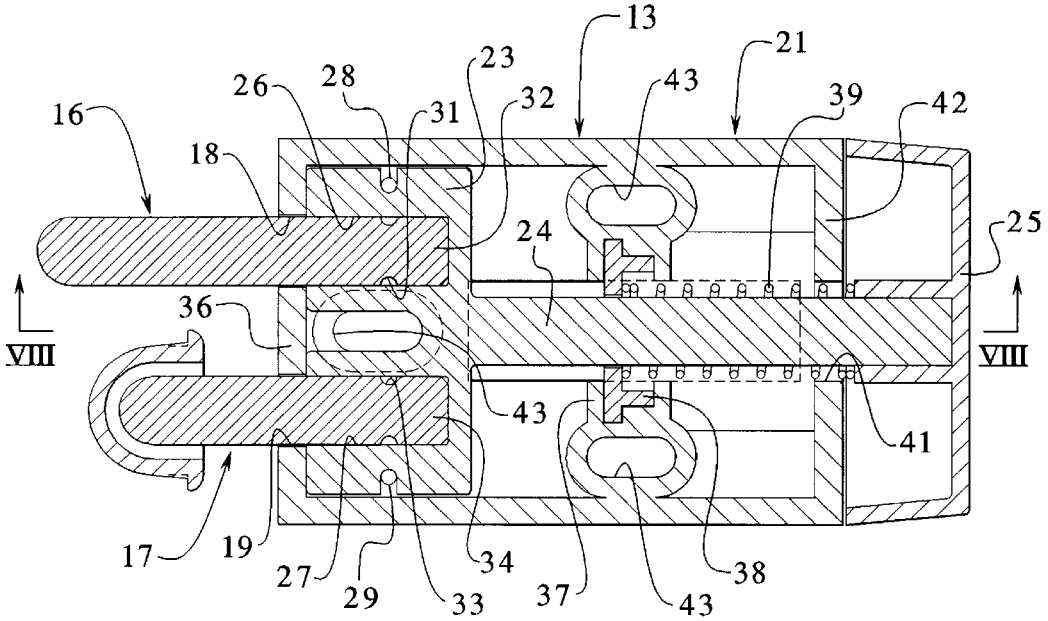
FIG. 5 is a sectional view of the limiter shown in FIG. 4 in the locked or activated position.

The construction of the limiter 13 is illustrated in greater detail in FIGS. 5–9. Turning first to FIG. 5, the rods 16,17 are detachably connected to a head 23 which, in turn, is connected to a shaft 24. The shaft 24 is connected to a cap 25. The head 23 includes two holes 26,27, each hole for receiving one of the rods 16, 17. Again, it will be noted that the rods 16, 17 are interchangeable within the holes 26, 27 of the head 23. The holes in the escutcheon 21 are shown at 18 and 19. To retain the rods 16, 17 and the holes 26,27 of the head 23, retainer clips or rings 28, 29 are provided. As shown in FIG. 5, the retainer clip 28 engages a slot 31 disposed in a proximate end 32 of the shaft 16. Similarly, the retainer clip 29 engages a slot 33 disposed in a proximate end 34 of the rod 17. Thus, the rods 16, 17 are frictionally received within the holes 26, 27 of the head 23 by way of the engagement of the rods 16,17 and the retainer clips 28, 29. Preferably, the rods 16, 17 are insertable and removable from the holes 26, 27 by manual pressure.

Still referring to FIG. 5, the head 23 is trapped inside the escutcheon 21 between a first end 36 of the escutcheon 21 and a bracket shown at 37. The bracket 37 accommodates a retaining plate 38. The retaining plate 38 engages one end of a first spring 39 which is disposed around the shaft 24 and extends through an opening 41 disposed in a second opposing end 42 of the escutcheon 21. Thus, as shown in FIG. 5, the spring 39 is trapped between the retaining plate 38 and the cap 25. Additional through holes are shown at 43 for mounting the escutcheon 21 to the door 10.

Figure 6:
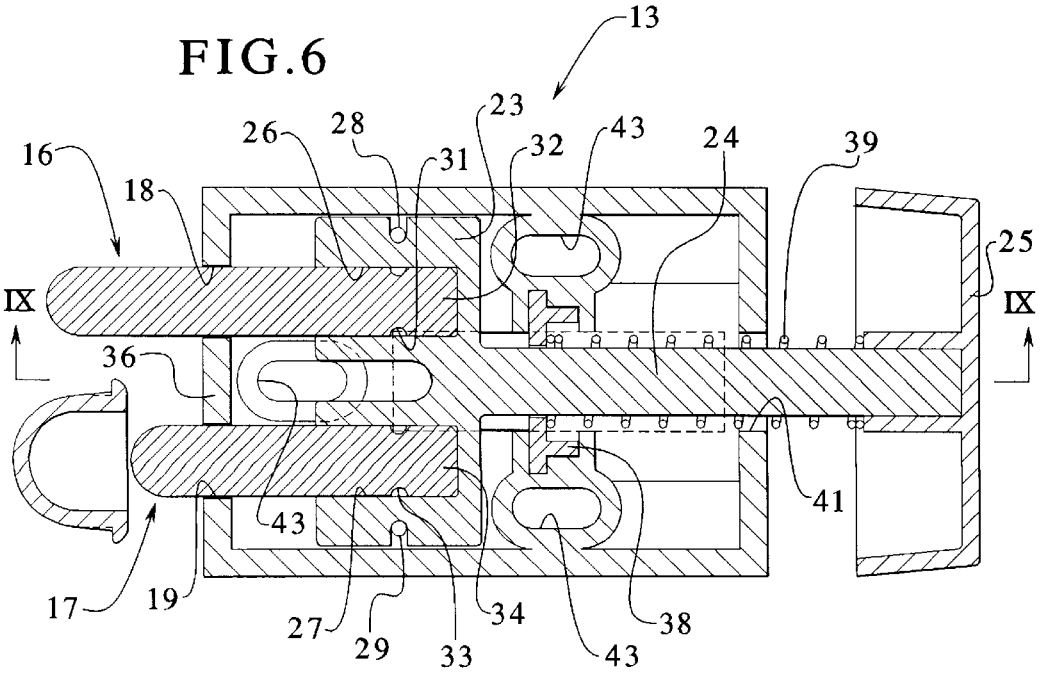
FIG. 6 is another sectional view of the limiter shown in FIG. 4 in the unlocked or deactivated position.

FIG. 5 illustrates the limiter 13 in the activated or limiting position. In contrast, FIG. 6 illustrates the limiter 13 in the outwardly biased position whereby the spring 39 has biased the shaft 24 outwards to a deactivated or retracted position.

Figure 7:
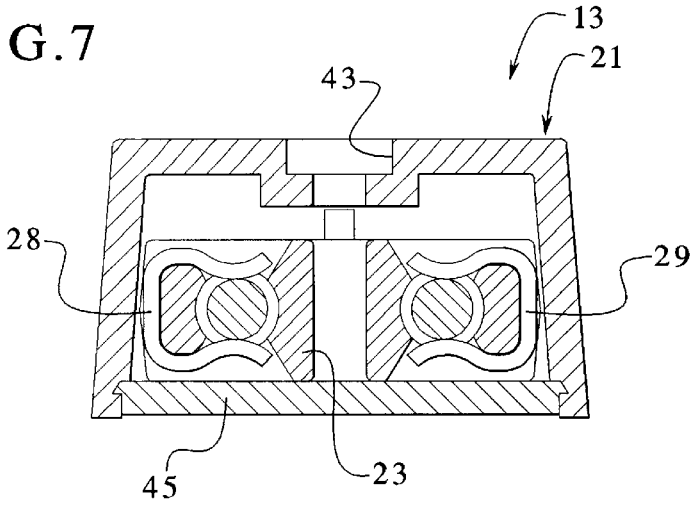
FIG. 7 is an end sectional view of the limiter shown in FIG. 4.

Turning to FIG. 7, a preferred configuration of the retainer clips 28, 29 is illustrated. It will be also noted that the escutcheon 21 may be connected to a base plate 45.

Figure 8:
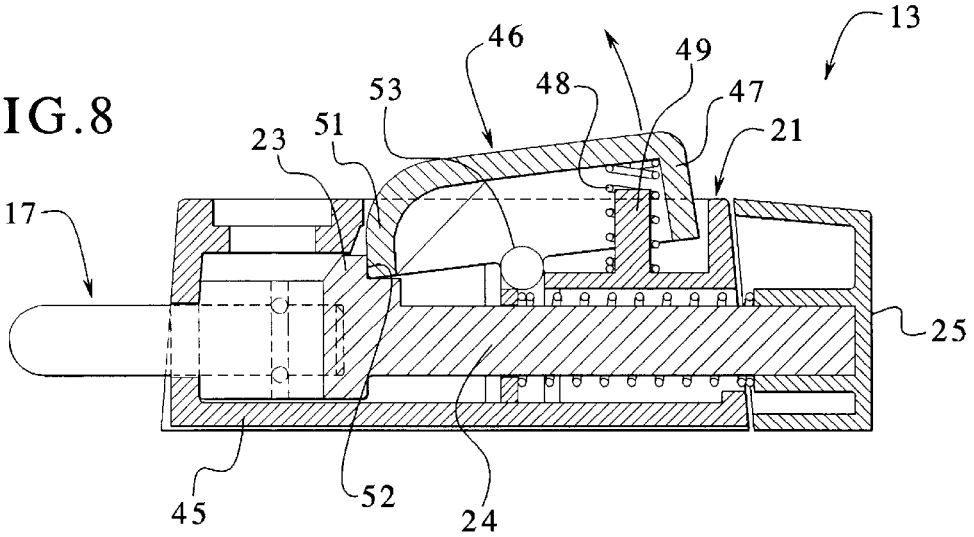
FIG. 8 is a side sectional view of the limiter as shown in FIG. 5.

Turning to FIG. 8, a button 46 is illustrated which is pivotally connected to the escutcheon 21. A first end 47 of the button is biased in an outward direction from the escutcheon 21 by a second spring 48. The spring 48 is mounted to a post 49 which extends integrally outward from the escutcheon 21. As a result, a second end 51 of the button 46 is pressed inwardly towards the escutcheon 21. As a result, when the cap 25 is depressed thereby moving the shaft 24 towards the activated position shown in FIG. 8, a ledge 52 disposed on the head 23 moves past the second end 51 of the button 46 and receives the second end 51 as shown in FIG. 8. In this position, the second end 51 of the button 46 locks the head 23, shaft 24 and rod 17 in the locking or activated position shown in FIG. 8. The button 46 pivots about the shaft shown at 53.

Figure 9:
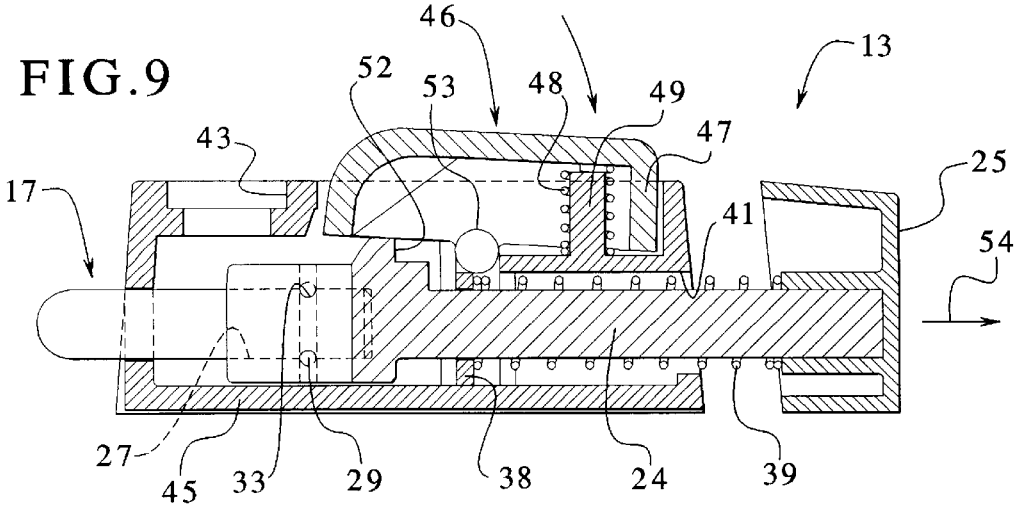
FIG. 9 is a side sectional view of the limiter as shown in FIG. 6.

To release the limiter 13 from the locking or activated position shown in FIG. 8, the first end 47 of the button 46 is pressed downward against the bias of the spring 48 as shown in FIG. 9. This action releases the second end 51 of the button 46 from the grip of the ledge 52 thereby enabling the spring 39 to bias the cap 25 and shaft 24 outwardly in the direction of the arrow 54 to the deactivated position shown in FIG. 9.

Accordingly, by providing a limiter 13 with two spaced apart positions for two shafts 16, 17 of differing lengths, a limiter 13 is provided which is far more versatile than the limiters or stops provided by the prior art. The shafts 16, 17 of either a longer or shorter length may be utilized in either offset position as indicated by the holes 18, 19 in the escutcheon 21 (see FIG. 4). As shown in FIG. 1, the limiter 13 may be mounted in close proximity to the guiding rib 22 for the sliding door 10. Further, as shown in FIGS. 2 and 3, the hole 55 disposed in the fixed door 11 may be moved to a lower position than shown in FIGS. 2 and 3. In addition, the limiter 13 may also be employed with two rods 16, 17 of differing or equal lengths for a more secure limiting, stopping or locking action.

From the above description, it is apparent that the objects and advantages of the present invention have been achieved. While only certain embodiments have been set forth, alternative embodiments and various modifications will be apparent from the above description to those skilled in the art. These and other alternatives are considered equivalents and within the spirit and scope of the present invention.

What is claimed is:

1. A limiter for a sliding door, the limiter comprising:

a shaft comprising a first end connected to a head and a second opposing end connected to a cap, the head comprising at least two spaced apart holes, each hole for matably and detachably receiving a rod that extends outward from the head and in a direction opposite the shaft, the head being disposed within an escutcheon for sliding movement within the escutcheon, the escutcheon for connecting the limiter to the door, the escutcheon comprising two opposing ends including a first end including at least two openings, each opening for slidably accommodating one of the rods and a second end including an opening for slidably accommodating the shaft, the escutcheon further comprising a bracket disposed between the first and second ends of the escutcheon for slidably accommodating the shaft, the head sliding between the first end of the escutcheon and the bracket, the limiter further comprising a first spring disposed between the bracket and the cap for biasing the shaft and the head into a retracted position, the head engaging the first end of the escutcheon when the limiter is in an extended position, the head engaging the bracket when the limiter is in the retracted position.

2. The limiter of claim 1 wherein the first spring is disposed around the shaft.

3. The limiter of claim 1 wherein the bracket is connected to a retaining plate, the first spring being disposed between the retaining plate and the cap.

4. The limiter of claim 1 wherein the escutcheon is pivotally connected to an actuator button, the button comprising two opposing ends including a first end that engages a second spring disposed between the button and the escutcheon and a second end, the second spring biasing the first end of the button outwards away from the escutcheon and the second end of the button inwards towards the head, the head comprising a ledge for engaging the second end of the button when the shaft and head have been pushed into a limiting position.

5. The limiter of claim 1 wherein the rods comprise a first rod and a second rod, the first rod being longer than the second rod, whereby the first and second rods of differing lengths can be selectively connected to the head.

6. The limiter of claim 1 wherein each rod comprises a proximate end that is matably received in one of the holes of the head and a distal end that extends outward from the head opposite the shaft, the proximate end of each rod comprising a groove, the head being connected to at least two retainers, each retainer extending into one of the holes for engaging the groove of one of the rods for detachably connecting said one of the rods to the head.

7. A limiter for a sliding door comprising:

a shaft comprising a first end connected to a head and a second opposing end connected to a cap, the head comprising a proximate end connected to the shaft and a distal end facing outwards away from the shaft, the distal end of the head comprising two spaced apart holes for detachably receiving two rods, each hole accommodating a retaining element for frictionally holding one of the rods in said hole, the head being disposed within an escutcheon for sliding movement within the escutcheon, the escutcheon for connecting the limiter to the door, the escutcheon comprising two opposing ends including a first end including at least two through openings for slidably accommodating the rods and a second end including an opening for slidably accommodating the shaft, the escutcheon further comprising a bracket disposed between the first and second ends of the escutcheon for slidably accommodating the shaft, the head sliding between the first end of the escutcheon and the bracket, the limiter further comprising a first spring disposed around the shaft and between the bracket and the cap for biasing the shaft into a retracted position, the proximate end of the head engaging the bracket when the limiter is in the retracted position, the distal end of the head engaging the first end of the escutcheon when the limiter is in an extended position, the escutcheon further being pivotally connected to a button, the button comprising two opposing ends including a first end that engages a second spring disposed between the button and the escutcheon and a second end, the second spring biasing the first end of the button outwards away from the escutcheon and the second end of the spring inwards towards the head, the head comprising a ledge for engaging the second end of the button when the shaft and head have been pushed into a limiting position, the engagement between the ledge and the second end of the button retaining the shaft and head in the limiting position until the first end of the button is depressed thereby pivoting the second end of the button outward away from the ledge of the head.

8. The limiter of claim 7 wherein the bracket is connected to a retaining plate, the first spring being disposed between the retaining plate and the cap.

9. The limiter of claim 7 wherein the rods comprise a first rod and a second rod, the first rod being longer than the second rod.

10. The limiter of claim 7 wherein each rod comprises a proximate end that is matably received in one of the holes of the head and a distal end that extends outward from the head opposite the shaft, the proximate end of each rod comprising a groove for engaging one of the retaining elements.

11. A limiter for a sliding glass door comprising:

a shaft comprising a first end connected to a head and a second opposing end connected to a cap, the head comprising a proximate end connected to the shaft and a distal end facing outwards away from the shaft, the distal end of the head comprising two spaced apart holes for detachably receiving two rods, each hole accommodating at least a portion of a retaining element for frictionally holding one of the rods in said hole, each rod comprising a proximate end that is matably received in one of the holes of the head and a distal end that extends outward from the head opposite the shaft, the proximate end of each rod comprising a groove for engaging one of the retaining elements, the head being disposed within an escutcheon for sliding movement within the escutcheon, the escutcheon for connecting the limiter to the door with a base plate being disposed between the escutcheon and the door, the escutcheon comprising two opposing ends including a first end including at least two through openings for slidably accommodating the rods and a second end including an opening for slidably accommodating the shaft, the escutcheon further comprising a bracket disposed between the first and second ends of the escutcheon for slidably accommodating the shaft, the bracket being connected to a retaining plate, the first spring being disposed between the retaining plate and the cap, the head sliding between the first end of the escutcheon and the bracket, the limiter further comprising a first spring disposed around the shaft and between the retaining plate and the cap for biasing the shaft into a retracted position, the proximate end of the head engaging the bracket when the limiter is in the retracted position, the distal end of the head engaging the first end of the escutcheon when the limiter is in an extended position, the escutcheon further being pivotally connected to a button, the button comprising two opposing ends including a first end that engages a second spring disposed between the button and the escutcheon and a second end, the second spring biasing the first end of the button outwards away from the escutcheon and the second end of the spring inwards towards the head, the head comprising a ledge for engaging the second end of the button when the shaft and head have been pushed into a limiting position, the engagement between the ledge and the second end of the button retaining the shaft and head in the limiting position until the first end of the button is depressed thereby pivoting the second end of the button outward away from the ledge of the head, the rods comprising a first rod and a second rod, the first rod being longer than the second rod.

* * * * *